United States Patent [19]

Berkowitz et al.

[11] 4,247,988

[45] Feb. 3, 1981

[54] PROCESS FOR REMOVING EXCESS WATER FROM ACTIVE CHLORINE COMPOUNDS

[75] Inventors: Sidney Berkowitz, Highland Park; James L. Manganaro, East Windsor; Charles V. Juelke, Belle Meade, all of N.J.

[73] Assignee: FMC Corporation, Philadelphia, Pa.

[21] Appl. No.: 80,882

[22] Filed: Oct. 1, 1979

[51] Int. Cl.[3] ..... F26B 3/34

[52] U.S. Cl. ..... 34/1; 219/10.55 R; 219/10.55 M; 204/157.1 R

[58] Field of Search ..... 204/157.1 R; 219/10.55 R, 10.55 M; 34/1

[56] References Cited

U.S. PATENT DOCUMENTS

| | | | |
|---|---|---|---|
| 2,615,259 | 10/1952 | Wade | 34/1 |
| 2,802,793 | 8/1957 | Coetzer et al. . | |
| 2,859,534 | 11/1958 | Copson . | |
| 2,949,677 | 8/1960 | Cameron . | |
| 2,969,360 | 1/1961 | Westfall . | |
| 3,048,928 | 8/1962 | Copson et al. . | |
| 3,270,017 | 8/1966 | Kovalsky et al. . | |
| 3,299,060 | 1/1967 | Kovalsky et al. . | |
| 3,307,010 | 2/1967 | Puschner . | |
| 3,668,204 | 6/1972 | Mesiah . | |
| 3,712,891 | 1/1973 | Berkowitz et al. . | |
| 3,803,144 | 4/1974 | Berkowitz . | |
| 3,818,004 | 6/1974 | Berkowitz . | |
| 3,834,038 | 9/1974 | Janda . | |
| 3,843,861 | 10/1974 | Van Amsterdam . | |
| 3,858,329 | 1/1975 | Koide et al. . | |
| 3,859,493 | 1/1975 | Peterson . | |
| 3,872,603 | 3/1975 | Williams et al. . | |
| 4,023,279 | 5/1977 | Janda | 219/10.55 M |
| 4,045,638 | 8/1977 | Chiang et al. . | |
| 4,045,639 | 8/1977 | Meisel . | |

*Primary Examiner*—Larry I. Schwartz

*Attorney, Agent, or Firm*—John J. Jones; F. Ianno

[57] ABSTRACT

Excess water, both crystalline and non-crystalline, is removed safely and rapidly from active chlorine compounds by applying electromagnetic energy with frequencies lower than infrared to vaporize the excess water.

9 Claims, No Drawings

PROCESS FOR REMOVING EXCESS WATER FROM ACTIVE CHLORINE COMPOUNDS

This invention relates to the removal of excess water from active chlorine compounds, and more particularly relates to a process whereby the energy required for the removal of such excess water is supplied by electromagnetic energy at a frequency lower than infrared.

Active chlorine compounds, because of their high oxidation potential, have found extensive use in many areas, including automatic dishwasher formulations, bleach formulations, and in swimming pool disinfection as bactericides and algaecides. Such compounds, when handled properly, are usually capable of providing suitable results in a safe manner. Unfortunately, the very property which makes them commercially useful, that is, their high oxidation potential, also makes them highly unstable and subject to rapid decomposition. Such decomposition is usually energetic and often quite violent, resulting not only in economic harm from lost production, but also in significant destruction to life and property, and in substantial air pollution. It is imperative, therefore, during manufacture and otherwise, that the decomposition temperatures of these active chlorine compounds be avoided.

The manufacture of many active chlorine compounds quite often includes a processing step whereby excess water must be removed from the compound. This is usually accomplished by vaporizing the excess water in flash dryers, fluid bed dryers, tray dryers, rotary dryers, and the like, all of which utilize lengthy conventional heating processes. These heating processes must, however, be closely controlled to facilitate against heating to the decomposition temperature of the active chlorine compound. Human, mechanical, and electro-mechanical controls all serve a useful and necessary purpose in preventing such occurrences. Nevertheless, the potential hazard still exists and decomposition still occurs with the attendant destruction.

The aforementioned circumstances are exemplified in the manufacture of calcium hypochlorite and its hydrates, and the chlorinated acids and salts of cyanuric acid, including trichloroisocyanuric acid, dichloroisocyanuric acid, sodium dichloroisocyanurate, potassium dichloroisocyanurate, and their respective hydrates.

According to the present invention, excess water can safely and rapidly be removed from active chlorine compounds by the application of sufficient electromagnetic energy with frequencies lower than infrared to the active chlorine compound to vaporize the excess water.

In carrying out the present invention, an active chlorine compound containing excess water is charged into an exposure zone, such as a microwave oven or a dielectric furnace, where electromagnetic energy at a frequency lower than infrared is applied to vaporize the excess water. An active chlorine compound is then recovered free of the excess water.

The active chlorine compound can be, for example, trichloroisocyanuric acid, dichloroisocyanuric acid, sodium dichloroisocyanurate, potassium dichloroisocyanurate, calcium hypochlorite, and their respective hydrates, including the dihydrates of sodium dichloroisocyanurate and calcium hypochlorite, and the monohydrates of dichloroisocyanuric acid, sodium dichloroisocyanurate, potassium dichloroisocyanurate, and calcium hypochlorite.

Excess water is defined and used herein to include free, non-cyrstalline water, that is, the water mixed with the acitve chlorine compound to make, for example, a wet cake, a slurry, or a solution; crystalline water which goes to make up the hydrated species of the active chlorine compound; and mixtures of these. For example, a slurry of sodium dichloroisocyanurate dihydrate contains both free, non-crystalline water—that which makes up the slurry—and crystalline water—that which makes up the dihydrate.

Where a dry powder of anhydrous sodium dichloroisocyanurate is to be produced from a slurry of the dihydrate, both the cyrstalline and the non-crystalline water must be removed as excess water. Where a dry powder or a more concentrated slurry of sodium dichloroisocyanurate dihydrate is to be produced from a dilute slurry of the dihydrate, only the non-crystalline water must be removed as excess water. Where the dry powder is being manufactured, all of the non-crystalline water is excess water which must be removed. Where the more concentrated slurry is being manufactured, only part of the non-crystalline water is to be removed as excess water.

Further, where a dry powder of sodium dichloroisocyanurate anhydrous or monohydrate is to be produced from a dry powder of the dihydrate, only the crystalline water must be removed as excess water. Where the anhydrous form is being manufactured, all of the crystalline water is to be removed as excess water. Where the monohydrate form is being manufactured, only part of the cyrstalline water is to be removed as excess water.

The prior art relied on conventional heating techniques to transfer energy from the heat source to the water. As a result, the drying times of the prior art were limited by the ability of the system to transfer heat. In addition, the temperature gradient of the prior art, with the potential for excessive localized heating, required longer heating times to provide closer control. Electromagnetic energy at a frequency lower than infrared is, however, applied directly to the water, and uniformly vaporizes the water without any substantial reliance on the heat transfer characteristics of the system. As a result, water removal is quite rapid. The time required to remove the excess water is a function of the frequency and the power input of the electromagnetic energy, the amount of excess water and the form of the excess water, that is, whether the excess water is free, non-crystalline water, crystalline water, or both. In general, the removal of crystalline water takes longer than the removal of free, non-crystalline water. It is preferable that the frequency and the power input of the electromagnetic energy be sufficient to remove the free, non-crystalline water, crystalline water, and mixtures of these, in a time period no longer than about 10 minutes. Where the excess water consists of free, non-crystalline water, it is more preferable that the frequency and the power input of the electromagnetic energy be sufficient to remove this excess water in a time period no longer than about 5 minutes.

In carrying out this invention, electromagnetic energy with frequencies lower than infrared are used. This includes microwave energy and dielectric heating means. The exact boundary between infrared and microwaves is not absolutely defined, although microwaves are generally considered to exist at frequencies ranging from about 300 MHz to about 300 GHz, thereby making the dividing boundary at approximately 300 GHz. Preferably, frequencies less than about 30 GHz should be used. Where microwaves are being used as the source of energy, frequencies from about 900 MHz to about 2,500 MHz are more preferred, while frequencies of either about 915 MHz or about 2,450 MHz are most preferred, since these have been set aside by the United States Federal Communications Commission for industrial applications and are readily available. When dielectric heating means are being used, polarity reversal at the electrodes should more preferably correspond to frequencies of about 3 MHz to about 100 MHz. With both microwave heating and dielectric heating, the heating process principally takes place by means of dielectric absorption resulting from exposure of the lossy water to the alternating potential gradient at the indicated frequencies.

The application of the aforementioned electromagnetic energy to remove excess water from active chlorine compounds provides a significant advantage over conventional heating processes. Unlike conventional heating, where an active chlorine compound continues to absorb energy after all of the water has been removed, electromagnetic energy with frequencies lower than infrared is not significantly absorbed by an active chlorine compound after all of the water has been removed. This invention therefore provides a failsafe mechanism against a thermally initiated decomposition caused by extended exposure to the energy source after all the water has been removed. In addition, the time required to remove the excess water is not limited by the heat transfer characteristics of the system, not is it limited by any potential for localized overheating.

The following examples are presented to illustrate the invention and are not deemed to be limiting thereof.

EXAMPLE 1

Run 1

A paper tray was charged with 50 g of wet cake sodium dichloroisocyanurate containing 34.0 weight percent available chlorine. The tray was placed in an microwave oven which has an operating frequency of about 2,450 MHz. The microwave energy, at a power setting of 1.4 KW, was applied to the wet cake for 30 seconds. The tray was removed from the oven and contained a free-flowing product with a 55.7 weight percent available chlorine content. X-ray diffraction analysis indicated the product to be essentially pure sodium dichloroisocyanurate dihydrate.

Run 2

Thirty (30) grams of the product from Run 1 were placed in the microwave oven for an additional 2.5 minutes at a power setting of 1.4 KW. A free-flowing product containing 59.6 weight percent available chlorine was removed from the oven. X-ray diffraction analysis indicated the product to be sodium dichloroisocyanurate monohydrate.

EXAMPLE 2

Run 3

A paper tray was charged with 25 g of free-flowing sodium dichloroisocyanurate dihydrate containing 55.8 weight percent available chlorine. The tray was placed in the microwave oven for 7 minutes with the microwaves at a power setting of 1.4 KW. A product containing 63.5 weight percent available chlorine was removed from the oven. X-ray diffraction analysis indicated the product to be anhydrous sodium dichloroisocyanurate.

Run 4

The product from Run 3 was placed in the microwave oven for an additional 5 minutes at a power setting of 1.4 KW. The product remained relatively cool and did not decompose.

EXAMPLE 3

A paper tray was charged with 35 g of wet cake sodium dichloroisocyanurate dihydrate containing 44.0 weight percent available chlorine. The tray was placed between the electrodes of a dielectric furnace which had a power output of 5 KW. After 5 minutes of heating, the tray was removed from the furnace and contained a free-flowing product with a 59.9 weight percent available chlorine content. X-ray diffraction analysis indicated the product to be pure sodium dichloroisocyanurate monohydrate.

EXAMPLE 4

A commercially available calcium hypochlorite product, with a theoretical available chlorine content of approximately 70 weight percent, was mixed with water to form a wet cake containing 53.7 weight percent available chlorine. Forty (40) grams of the wet cake calcium hypochlorite was placed on a paper tray. The tray was placed in the microwave oven for 3 minutes with the microwaves at a power setting of 1.4 KW. A free-flowing product containing 69.1 weight percent available chlorine was removed from the oven. Continued exposure of this product to microwaves for an additional 10 minutes did not decompose the product.

EXAMPLE 5

A paper tray was charged with 50 g of wet cake potassium dichloroisocyanurate monohydrate containing 50.8 weight percent available chlorine. The tray was placed in the microwave oven for 3 minutes with the microwaves at a power setting of 1.4 KW. A free-flowing crystalline product was removed from the oven. X-ray diffraction analysis indicated the product to be essentially pure anhydrous potassium dichloroisocyanurate. Further extended exposure of this product to microwaves did not overheat the product nor did the product decompose.

EXAMPLE 6

A paper tray was charged with 35 g of wet cake trichloroisocyanuric acid containing 73.7 weight percent available chlorine. The tray was placed in the microwave oven for 6 minutes with the microwaves at a power setting of 1.4 KW. A free-flowing product was removed from the oven. X-ray diffraction analysis indicated the product to be essentially pure trichloroisocyanuric acid.

EXAMPLE 7

A paper tray was charged with 50 g of wet cake dichloroisocyanuric acid monohydrate containing 47.5 weight percent available chlorine. The tray was placed in the microwave oven for 7 minutes with the microwaves at a power setting of 1.4 KW. A free-flowing product was removed from the oven. X-ray diffraction analysis indicated the product to be essentially pure anhydrous dichloroisocyanuric acid.

We claim:

1. A process for the removal of hydrate water from active chlorine compounds, which comprises applying sufficient electromagnetic energy with frequencies lower than infrared to an active chlorine compound containing hydrate water to vaporize said hydrate water.

2. The process of claim 1 wherein said active chlorine compound is selected from the group consisting of the respective hydrates of dichloroisocyanuric acid, sodium dichloroisocyanurate, potassium dichloroisocyanurate, and calcium hypochlorite.

3. The process of claim 1 wherein said electromagnetic energy is supplied as microwave energy.

4. The process of claim 3 wherein said microwave energy is applied at a frequency of about 900 MHz to about 2,500 MHz.

5. The process of claim 3 wherein said microwave energy is applied at a frequency of about 2,450 MHz.

6. The process of claim 3 wherein said microwave energy is applied at a frequency of about 915 MHz.

7. The process of claim 1 wherein said electromagnetic energy is supplied by dielectric heating means.

8. The process of claim 7 wherein said dielectric heating means is applied at a frequency of about 3 MHz to about 100 MHz.

9. The process of claims 1, 2, 3 or 7, wherein a sufficient amount of said energy is supplied to vaporize said hydrate water in period of time no longer than about 10 minutes.

* * * * *